United States Patent [19]

Schmitt et al.

[11] 4,155,861

[45] May 22, 1979

[54] ESTER LUBRICANT

[75] Inventors: Karl Schmitt, Herne; Josef Disteldorf, Wanne-Eickel; Werner Flakus, Herne, all of Fed. Rep. of Germany

[73] Assignee: Studiengesellschaft Aktiengesellschaft, Gelsenkirchen-Buer, Fed. Rep. of Germany

[21] Appl. No.: 771,047

[22] Filed: Feb. 22, 1977

Related U.S. Application Data

[63] Continuation of Ser. No. 622,781, Oct. 15, 1975, abandoned, which is a continuation of Ser. No. 495,750, Aug. 8, 1974, abandoned, which is a continuation of Ser. No. 354,817, Apr. 26, 1973, abandoned, which is a continuation of Ser. No. 140,621, May 5, 1971, abandoned, which is a continuation of Ser. No. 804,300, Mar. 4, 1969, abandoned.

[51] Int. Cl.[2] ..... C10M 1/24

[52] U.S. Cl. ..... 252/56 S; 560/199

[58] Field of Search ..... 252/56 S; 260/488 G

[56] References Cited

U.S. PATENT DOCUMENTS

| | | | |
|---|---|---|---|
| 2,548,493 | 4/1951 | Robey | 252/56 S X |
| 2,929,786 | 3/1960 | Young et al. | 252/56 S |
| 3,016,353 | 1/1962 | Matuszak | 252/56 S |
| 3,029,204 | 4/1962 | Matuszak et al. | 252/56 S |

*Primary Examiner*—Delbert E. Gantz
*Assistant Examiner*—Andrew H. Metz
*Attorney, Agent, or Firm*—Sprung, Felfe, Horn, Lynch & Kramer

[57] ABSTRACT

Lubricant comprising in admixture a monomeric ester of a branched dicarboxyic acid and aliphatic, primary monoalcohol, and a complex ester of dicarboxylic acid and hexanediol or trimethyl hexanediol.

9 Claims, No Drawings

ESTER LUBRICANT

This is a continuation of application Ser. No. 622,781 filed Oct. 15, 1975, now abandoned, which is a continuation of application Ser. No. 495,750 filed Aug. 8, 1974, now abandoned, which is a continuation of application Ser. No. 354,817 filed Apr. 26, 1973, now abandoned, which is a continuation of application Ser. No. 140,621 filed May 5, 1971, now abandoned, which is a continuation of application Ser. No. 804,300 filed Mar. 4, 1969, now abandoned.

BACKGROUND

It is in the prior art to use aliphatic diesters of dicarboxylic acids as efficient lubricants, hydraulic fluids, cutting oils, etc. Indeed, on the basis of present theoretical knowledge and practical experience, it is possible by precise selection of the ester components to achieve products having very specific properties. Despite their proven efficiency, however, such made-to-order individual esters have a very narrow scope of application and are seldom universally usable, and for this reason it is generally necessary to prepare a special ester oil for each application. For example, on the basis of its physical and chemical properties, the monomeric ester oil which is described in detail in Table 1, Column 1, can be used directly for the lubrication of transmissions and refrigeration machines, but for use as an all weather motor oil must be used in mixtures with mineral oils.

THE INVENTION

The problem and aim of the present invention is modifying a given monomeric ester oil of good characteristics but of limited applications merely by admixturing of quantities of one and the same modifier in each case, in such a manner that the various resultant formulations will be highly suitable for various of the most important fields of application and the most important specifications of lubrication technology.

This problem is solved according to the invention in that, in each case, a quantity of a complex ester based on dicarboxylic acid, preferably branched, and hexanediol or trimethyl hexanediol, is added to a monomeric ester of a branched dicarboxylic acid.

Tables 1 to 8 list the characteristics of lubricants according to the invention in relation to their percentage contents of complex ester. For example, by the addition of 1 to 10% of a specified complex ester to the monomeric ester oil listed, lubricants are obtained which can be used to particular advantage for the lubrication of transmissions, and, in addition, for the preparation of wide-range motor oils of SAE classes 5W/20, 5W/30 or 10W/40, which are thus usable also as driving fluid for high-vacuum pumps, and as industrial oils, and finally they can be used for the ATF field. Higher percentages of complex esters result in lubricants meeting requirements for extreme pressure, gear service and for hydraulic processes.

The complex esters are prepared by condensing a monofunctional component, such as an alcohol or a monocarboxylic acid, with dicarboxylic acids and diols of a certain chain length and structure. Complex esters made of branched ester components combined with linear or other branched ester components of a certain chain length always improve monomeric esters. All systems that differ from this combination, such as, for example, completely linear complex esters, are definitely lower in efficiency than those mentioned above, and are often incompatible with the monomeric esters.

In a systematic study of the performance of numerous complex esters in relation with a number of monomeric esters, it was found that complex esters on the basis of trimethyl adipic acid and hexanediol, or trimethyl adipic acid and trimethyl hexanediol are particularly outstanding both in performance and in range of applications.

It is important in practice to add to given ester oil only those complex esters which offer the assurance of mutual compatibility. Compatibility determined on the basis of mixing procedures alone is not sufficient to assure this. When the system is subjected to thermal stresses, re-esterification reactions sometimes occur, which might result in incompatibility. For the preparation of the monomeric dicarboxylic acid esters and complex esters which together produce the lubricant according to the invention, it is therefore advantageous to use only the same dicarboxylic acid or one that is very closely related to it structurally in the monomeric ester and the complex ester.

In matching the complex ester to the monomeric ester oil as regards material composition, it is furthermore advantageous to see to it that, in the case of oxidative, thermal or hydrolytic decomposition processes which ultimately occur at high stress, most of the cleavage products that result are intercepted and react in such a manner that, under ideal circumstances, the composition of the end product is not at all or only slightly affected thereby.

In the individual columns of Table 1, the applications of the individual mixtures are stated. The great advantage that can be achieved by the invention consists in the fact that merely by the addition of different quantities of a single complex ester to one and the same monomeric ester oil, high-performance lubricants are obtained for practically all important applications.

Although trimethyl adipic acid octyldecyl ester (a diester) is given in all the tables as the monomeric ester, the effect described is nevertheless also obtained when a monomeric ester is used which is based on branched glutaric acid or branched succinic acid, as for example monomethyl glutaric acid, dimethyl glutaric acid, monomethyl succinic acid, dimethyl succinic acid, monomethyl malonic acid, dimethyl malonic acid, etc.

The complex esters to be used according to the invention are prepared in the following manner:

The listed quantities of a dicarboxylic acid ester, a diol, and 0.05 to 0.1% of the total quantity of tetraalkyl titanate (generally tetraisopropyl titanate) are condensed at temperatures of 150° to 250° under nitrogen shielding, and with the yielding of a quantity of monoalcohol equivalent to the amount of diol used. The removal of the last volatile components is performed in vacuo.

The complex esters mentioned in Tables 1–8 possess the following characteristics:

Complex Ester I

Prepared by the reaction of 1.02 mole trimethyladipic acid dimethyl ester and 1.0 mole hexanediol-1,6, according to the general instructions.

Characteristics of the complex ester:

Pour point ° C. = +6

Flash point ° C. = 304

Molecular weight: 3300

Complex Ester II

Prepared by the reaction of
1.5 moles of trimethyladipic acid dimethyl ester and
1.0 mole of hexanediol-1,6, according to the general instructions.

Characteristics of the complex ester:
Viscosity at 100° F. in centistokes=396
Viscosity at 210° F. in cSt=35.75
Pour point ° C.=−10
Flash point ° C.=285
Mol. Weight=1030

Complex Ester III

Prepared by the reaction of
1.02 moles of trimethyladipic acid dimethyl ester and
1.0 mole of trimethylhexanediol-1,6 according to the general instructions.

Characteristics of the complex ester:
Viscosity at 210° F. in cSt=735
Pour point ° C.=+7
Flash point ° C.=316
Molecular weight=2815

Complex Ester IV

Prepared by the reaction of
1.5 moles of trimethyladipic acid dimethyl ester and
1.0 mole of trimethylhexanediol-1,6 according to the general instructions.

Characteristics of the complex ester:
Viscosity at 100° F. in cSt=341.5
Viscosity at 210° F. in cSt=137.1
Pour point ° C.=0
Flash point ° C.=305
Molecular weight=1640

Complex Ester V

Prepared by the reaction of
1.02 moles of trimethyladipic acid octyl decyl ester and
1.0 mole of hexanediol-1,6 according to the general instructions.

Characteristics of the complex ester:
Viscosity at 100° F. in cSt=1859
Viscosity at 210° F. in cSt=134
Pour point ° C.=−10
Flash point ° C.=286
Molecular weight=1600

Complex Ester VI

Prepared by the reaction of
1.5 moles of trimethyladipic acid octyl decyl ester and
1.0 mole of hexanediol-1,6 according to the general instructions.

Characteristics of the complex ester:
Viscosity at 100° F. in cSt=117.7
Viscosity at 210° F. in cSt=15.85
Pour point ° C.=−38
Flash point ° C.=261
Molecular weight=850

Complex Ester VII

Prepared by the reaction of
1.02 moles of trimethyladipic acid octyl decyl ester and
1.0 mole of trimethylhexanediol-1,6 according to the instructions.

Characteristics of the complex ester:
Viscosity at 210° F. in cSt=650
Pour point ° C.=+10
Flash point ° C.=265
Molecular weight=1770

Complex Ester VIII

Prepared by the reaction of
1.5 moles of trimethyladipic acid octyl decyl ester and
1.0 mole of trimethyl hexanediol-1,6 according to the general instructions.

Characteristics of the complex ester:
Viscosity at 210° F. in cSt=97.3
Pour point ° C.=−10
Flash point ° C.=273
Molecular weight=1290

Table 1

Properties of Ester Oil Formulations According to their Percentage Content of Complex Esters

| | | | | |
|---|---|---|---|---|
| Complex ester I, % | 0 | 4 | 7 | 27 |
| Trimethyl adipic acid octyl decyl ester, % | 100 | 96 | 93 | 73 |
| Viscosity at 100° F. in cSt | 12.74 | 18.18 | 22.73 | 126.4 |
| Viscosity at 210° F. in cSt | 3.25 | 4.43 | 5.30 | 21.53 |
| Viscosity index | 141 | 175 | 169 | 143 |
| Pour point °C. | −73 | −65 | −59 | −35 |
| Flash point °C. | 224 | 226 | 230 | 243 |
| Noach value % | 14.7 | 13.5 | 11.4 | 7.8 |
| Applications: | | | | |
| Lubricant for: | A* | B* | C* | D* |

A*: Transmissions, refrigeration machines, internal combustion engines.
B*: Same, and also as driving fluid for vacuum pumps.
C*: Same, as the foregoing, and also for gears.
D*: Extreme-pressure gear lubricant, and as hydraulic fluid.

Table 2

| | | |
|---|---|---|
| Complex Ester II, % | 22.5 | 81.5 |
| Trimethyl adipic acid octyl decyl ester, % | 77.5 | 18.5 |
| Viscosity at 100° F. in cSt | 25.09 | 189.9 |
| Viscosity at 210° F. in cSt | 5.35 | 21.38 |
| Viscosity index | 155 | 125 |
| Pour point °C. | −53 | −17 |
| Flash point °C. | 233 | 248 |

Applications, same as in Table 1, but with modified specifications.

Table 3

| | | | |
|---|---|---|---|
| Complex Ester III, % | 4 | 7 | 27 |
| Trimethyl adipic acid octyl decyl ester, % | 96 | 93 | 73 |
| Viscosity at 100° F. in cSt | 17.6 | 21.1 | 83.3 |
| Viscosity at 210° F. in cSt | 4.23 | 4.98 | 14.25 |
| Viscosity index | 168 | 171 | 144 |
| Pour point °C. | −69 | −66 | −49 |
| Flash point °C. | 230 | 233 | 239 |

Applications, same as in Table 1, but with modified specifications.

Table 4

| | | | |
|---|---|---|---|
| Complex Ester IV, % | 4 | 7 | 27 |
| Trimethyl adipic acid octyl decyl ester, % | 96 | 93 | 73 |
| Viscosity at 100° F. in cSt | 15.30 | 17.58 | 41.8 |
| Viscosity at 210° F. in cSt | 3.81 | 4.37 | 7.91 |
| Viscosity index | 163 | 175 | 147 |
| Pour point °C. | −71 | −65 | −56 |
| Flash point °C. | 230 | 235 | 243 |

Applications, same as in Table 1, but with modified specifications.

Table 5

| | | |
|---|---|---|
| Complex Ester V, % | 7 | 27 |
| Trimethyl adipic acid octyl decyl ester, % | 93 | 73 |
| Viscosity at 100° F. in cSt | 18.69 | 48.75 |
| Viscosity at 210° F. in cSt | 4.45 | 9.11 |
| Viscosity Index | 1/0.1 | 148 |
| Pour point °C. | −71 | −57 |

Table 5-continued

| Flash point °C. | 233 | 238 |
|---|---|---|

Applications, same as in Table 1, but with modified specifications.

Table 6

| Complex Ester VI, % | 4 | 7 | 31 |
|---|---|---|---|
| Trimethyl adipic acid octyl decyl ester, % | 96 | 93 | 69 |
| Viscosity at 100° F. in cSt | 14.23 | 15.15 | 24.59 |
| Viscosity at 210° F. in cSt | 3.55 | 3.72 | 5.33 |
| Viscosity index | 151 | 155 | 158 |
| Pour point °C. | −70 | −68 | −53 |
| Flash point °C. | 229 | 238 | 244 |

Applications, same as in Table 1, but with modified specifications.

Table 7

| Complex Ester VII, % | 4 | 7 | 27 |
|---|---|---|---|
| Trimethyl adipic acid octyl decyl ester, % | 96 | 93 | 73 |
| Viscosity at 100° F. in cSt | 16.00 | 18.8 | 61.2 |
| Viscosity at 210° F. in cSt | 3.99 | 4.31 | 10.08 |
| Viscosity index | 171 | 159 | 139 |
| Pour point °C. | −68 | −65 | −53 |
| Flash point °C. | 227 | 232 | 240 |

Applications, same as in Table 1, but with modified specifications.

Table 8

| Complex Ester VIII, % | 4 | 7 | 27 |
|---|---|---|---|
| Trimethyl adipic acid octyl decyl ester, % | 96 | 93 | 73 |
| Viscosity at 100° F. in cSt | 15.25 | 16.35 | 41.8 |
| Viscosity at 210° F. in cSt | 3.8 | 3.99 | 7.91 |
| Viscosity index | 162 | 167 | 147 |
| Pour point °C. | −64 | −67 | −56 |
| Flash point °C. | 230 | 233 | 240 |

Applications, same as in Table 1, but with modified specifications.

Thus, the invention provides a lubricant comprising in admixture a monomeric ester of a branched dicarboxylic acid and aliphatic, primary monoalcohol, and a complex ester of dicarboxylic acid and hexanediol or trimethyl hexanediol. The acid component of the monomeric ester is preferably branched derivative of adipic acid; it can be, however, a branched derivative of malonic, succinic, or glutaric. The monomeric ester is a diester, preferably of an alkyl alcohol, e.g. an alcohol of 6–12 carbon atoms. Preferably the alcohol moiety is the residue of a straight chain alcohol, and the diester is a mixed diester derived from alcohols as referred to.

The complex ester is a transesterification product of about 1–2 moles of an alkyl ester of a dicarboxylic acid and one mole of hexanediol, having an average molecular weight of about 500–4000. Preferably, said molar ratio is about 1.5–1 to 1. The dicarboxylic acid preferably contains 3–6 carbon atoms in a straight chain and preferably has lower alkyl branches. The dicarboxylic acid ester reactant in the transesterification is preferably an alkyl diester.

What is claimed is:

1. Lubricant consisting essentially of an admixture of:

(a) a monomeric diester of a lower alkyl branched dicarboxylic acid and aliphatic, primary monoalcohol, wherein the lower alkyl branched acid is selected from the group consisting of glutaric, succinic, malonic, adipic and mixtures thereof, (b) a complex ester having a molecular weight of about 500–4000 of trimethyadipic acid diester and hexanediol-1,6 or trimethyl hexanediol-1,6 in the proportion of about 1–2 moles of the dicarboxylic acid diester to 1 mole of the diol, (c) said complex ester being present in said admixture in amount of 1–81.5% thereof.

2. Lubricant according to claim 1, said monomeric ester being an ester of trimethyladipic acid.

3. Lubricant according to claim 1, said monoalcohol of the monomeric ester being a straight chain alcohol.

4. Lubricant according to claim 3, the monoalcohol residues of monomeric ester being $C_6$–$C_{12}$.

5. Lubricant according to claim 1, wherein said complex ester is a transesterification product of about 1–2 moles of trimethyladipic acid alkyl diester and 1 mole of hexanediol-1,6 or trimethylhexanediol-1,6.

6. Lubricant according to claim 1, said monomeric ester being a diester of trimethyladipic acid and octyl and decylalcohol.

7. Lubricant according to claim 6, said molar ratio being about 1.5–1 to 1.

8. Lubricant according to claim 6, said complex ester being present in said mixture in amount of 1–10% thereof.

9. Lubricant according to claim 5, wherein said trimethyladipic acid alkyl diester is lower alkyl diester.

* * * * *